United States Patent [19]

Brubacher

[11] 3,953,024

[45] Apr. 27, 1976

[54] WATER TUMBLER AND ROLLER FLOAT

[75] Inventor: Leonard M. G. Brubacher, West Montrose, Canada

[73] Assignee: The Raymond Lee Organization, Inc., New York, N.Y. ; a part interest

[22] Filed: Jan. 6, 1975

[21] Appl. No.: 539,007

[52] U.S. Cl. ..... 272/1 E; 9/310 F; 115/20

[51] Int. Cl.[2] ..... B63B 35/72

[58] Field of Search ..... 114/.5 F; 115/20; 272/1 E, 1 B, 60 R; 9/310 F, 310 G

[56] References Cited

UNITED STATES PATENTS

| | | | |
|---|---|---|---|
| 1,798,594 | 3/1931 | Deppner | 115/20 |
| 2,175,197 | 10/1939 | Kent, Jr. | 272/1 B |
| 2,216,656 | 10/1940 | Smythe | 115/20 |
| 3,223,411 | 12/1965 | Becroft | 272/1 B |

*Primary Examiner*—Trygve M. Blix
*Assistant Examiner*—Stuart M. Goldstein
*Attorney, Agent, or Firm*—Howard I. Podell

[57] ABSTRACT

A hollow semi-rigid cigar-shaped float formed with helical external projections in the form of two corkscrew threads for use in water sport. Each corkscrew thread projection is formed from the middle of the float to an end, with one end of the float shaped as a right hand thread and the other shaped as a left hand thread. When a swimmer stands on the middle portion of the float, in water, and causes the float to rotate, the effect of the external rotation of both threads in the water, cancels any sidewise thrust of either thread. However, by shifting his position on the float so that a greater length of one thread is immersed in the water, the user may cause the float to move in one axial direction or the other, when the float is caused to rotate, in simulated log-rolling fashion. A quantity of water may be added to the internal recess of the float for purposes of ballast and the internal surface of the float may be fitted with projections to retard the motion of the water ballast, in relation to the internal wall of the float.

3 Claims, 4 Drawing Figures

WATER TUMBLER AND ROLLER FLOAT

SUMMARY OF THE INVENTION

My invention is a hollow semi-rigid cigar-shaped float formed with helical external projections in the form of two corkscrew threads for use in water sport.

Each corkscrew thread projection is formed from the middle of the float to an end, with one end of the float shaped as a right hand thread and the other shaped as a left hand thread.

When a swimmer stands on the middle portion of the float, in water, and causes the float to rotate, the effect of the external rotation of both threads in the water, cancels any sidewise thrust of either thread.

However, by shifting his position on the float so that a greater length of one thread is immersed in the water, the user may cause the float to move in one axial direction or the other, when the float is caused to rotate, in simulated log-rolling fashion.

A quantity of water may be added to the internal recess of the float for purposes of ballast and the internal surface of the float may be fitted with projections to retard the motion of the water ballast, in relation to the internal wall of the float.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
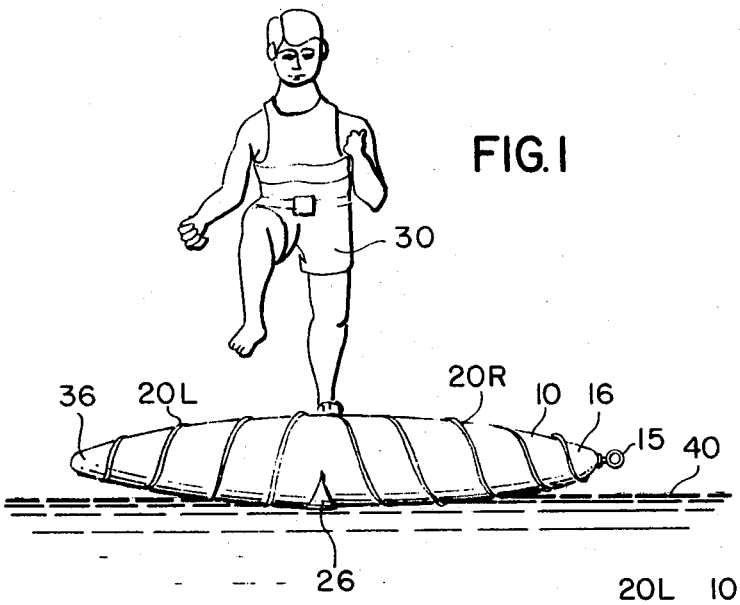
FIG. 1 is a perspective view of the invention in use in a balanced position.

Turning now descriptively to the drawings, in which similar reference characters denote similar elements throughout the several views, FIGS. 1–4 illustrate the roller and tumbler float 10 which is formed of a semi-rigid skin 11 enclosing a hollow interior 12 inflated with air and containing a quantity of water 14 as ballast. The float 10 is shaped in the general profile of a cigar, with an eye 15 mounted in one end 16 for towing purposes. A corkscrew helical thread of right-hand configuration is formed by a continuous external projection 20R from the mid-portion 26 of the float 10 to a first end 16 of the float, with a similar thread 20 L of left-hand configuration formed from the mid-portion 26 to the other end 36 of the float.

When the float 10 is rotated by the user 30 in simulated log-rolling fashion in a given direction, there will be no movement of the float in the axial direction, as shown in FIG. 1, when the user stands on the mid-section 26 with the sections fitted with projections 20 L and 20 R both in the water 40.

Figure 2:
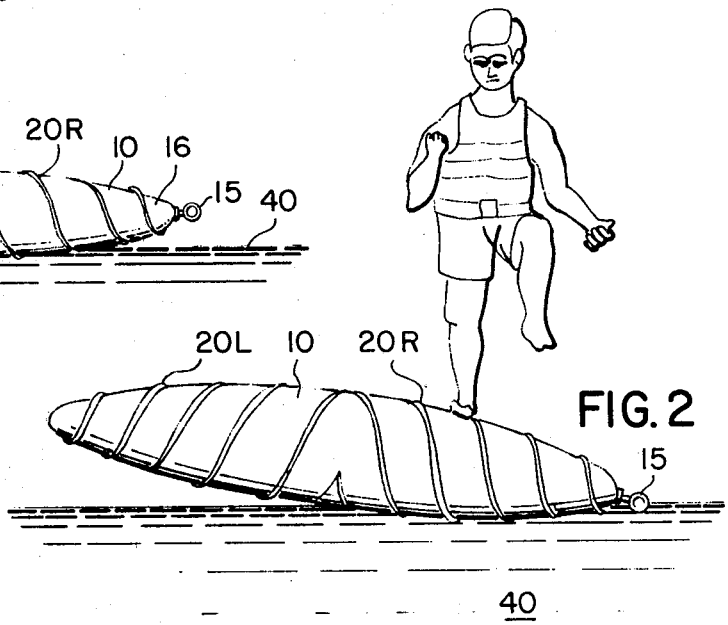
FIG. 2 is a perspective view of the invention in use with a first end, only, immersed in the water.
Figure 3:
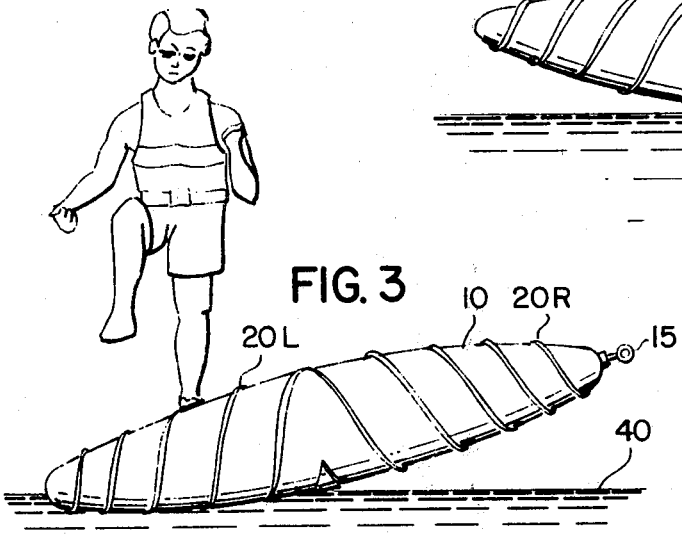
FIG. 3 is a perspective view of the invention in use with a second end, only, immersed in the water.
Figure 4:
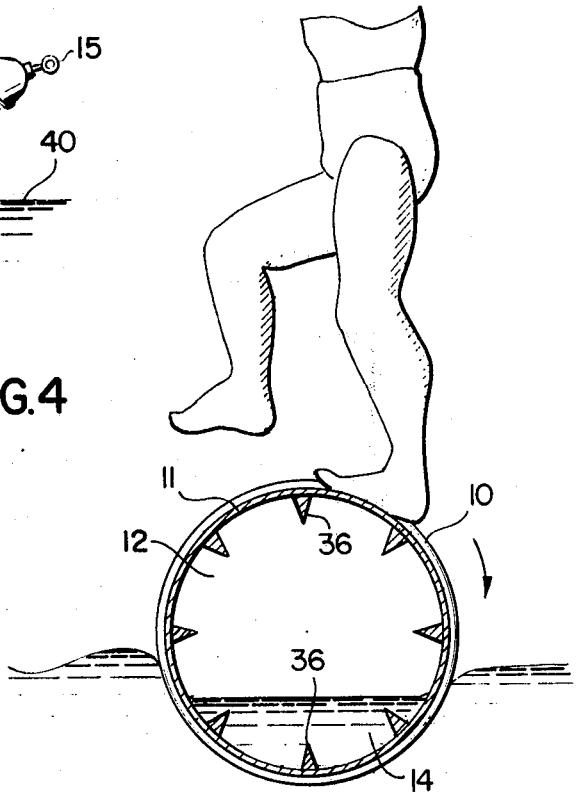
FIG. 4 is a sectional view of the invention in use.

As shown in FIG. 2, the user 30, by shifting his position to lift the left-hand threads 20L out of the water, will now cause the float to move in a first axial direction by rotation of the float in a given direction. As shown in FIG. 3, the float will move in the opposite axial direction, when the user stands on the section fitted with the left hand threads 20L so as to lift the right hand thread projections out of the water 40.

The inertia effect of the water ballast 14 inside the float 10 is enhanced by internal radial projections 36 on the internal surface of the float.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A hollow float which may be utilized in water to simulate the art of log-rolling by a user standing on the float, comprising a float in the form of a semi-rigid skin enclosing a hollow interior which interior may be inflated with air or other gas to form a resilient body of a generally circular cross-section, with the length of the body being greater than the maximum diameter of the cross-section so as to form a cigar-like shape when inflated, with projections integrally fitted to the skin, said projections shaped in the form of a helical thread so as to provide axial movement to the inflated float when the float is rotated in the water.

2. The combination as recited in claim 1 in which one end section of the float is formed with projections in the shape of a left hand screw thread and the other end section is formed with projections of a right hand thread.

3. The combination as recited in claim 1 in which internal radial projections are formed in the interior wall surfaces of the float to restrain the motion of water ballast which may be in the interior of the float.

* * * * *